US005568856A

United States Patent [19]

Colley et al.

[11] Patent Number: 5,568,856

[45] Date of Patent: Oct. 29, 1996

[54] DEVICE FOR TRANSPORTING AND STORING CIGARETTES

[75] Inventors: Robert G. Colley, Arnold, United Kingdom; Harald Gosebruch, Verden, Germany

[73] Assignee: Focke & Co. (GmbH & Co.), Verden, Germany

[21] Appl. No.: 464,767

[22] PCT Filed: Dec. 15, 1993

[86] PCT No.: PCT/EP93/03569

§ 371 Date: Jun. 14, 1995

§ 102(e) Date: Jun. 14, 1995

[87] PCT Pub. No.: WO94/13161

PCT Pub. Date: Jun. 23, 1994

[30] Foreign Application Priority Data

Dec. 15, 1992 [GB] United Kingdom ..... 9226117

[51] Int. Cl.[6] ..... B65G 1/00

[52] U.S. Cl. ..... 198/347.2; 198/347.3

[58] Field of Search ..... 198/347.1, 347.2, 198/347.3

[56] References Cited

U.S. PATENT DOCUMENTS

| | | | |
|---|---|---|---|
| 4,366,895 | 1/1983 | Bennett et al. | 198/347.3 X |
| 4,423,996 | 1/1984 | Applegate et al. | 198/347.3 X |
| 4,593,965 | 3/1985 | Applegate et al. | 198/347.3 X |
| 4,744,453 | 5/1988 | Krause et al. | 198/347.2 |
| 5,462,153 | 10/1995 | Friis | 198/347.2 X |

FOREIGN PATENT DOCUMENTS

| | | | |
|---|---|---|---|
| 336897 | 3/1989 | European Pat. Off. . | |
| 1546485 | 11/1968 | France . | |
| 2347896 | 11/1977 | France . | |
| 2414459 | 8/1979 | France . | |
| 926043 | 11/1959 | United Kingdom . | |
| 2024758 | 1/1980 | United Kingdom | 198/347.3 |
| 2062567 | 5/1981 | United Kingdom . | |

*Primary Examiner*—James R. Bidwell

*Attorney, Agent, or Firm*—Sughrue, Mion, Zinn, Macpeak & Seas

[57] ABSTRACT

A device is disclosed for transporting and storing cigarettes. High performance packaging machines require a correspondingly large stock of cigarettes. Several containers (21) are fixedly assembled into a storage unit (20). Each container (21) receives a large number of cigarettes. The containers (21) are filled and emptied through an opening (26) arranged in the bottom wall (28) without any change in their relative position. A conveyor (16) for filling and emptying the containers (21) is also designed in a special manner. It has two separate conveyor shafts (40, 41) for filling and emptying the containers (21).

13 Claims, 3 Drawing Sheets

DEVICE FOR TRANSPORTING AND STORING CIGARETTES

BACKGROUND OF THE INVENTION

The invention relates to a device for transporting and storing cigarettes, having a storage unit comprising several containers which are arranged one beside the other and are connected fixedly to one another, and having a cigarette conveyor for feeding the cigarettes, in particular, from a cigarette-making machine and conveying away the cigarettes, in particular to a packaging machine, it being possible for the individual containers to be filled or emptied one after the other in a filling station by the cigarette conveyor (16).

The handling of cigarettes, after they have been manufactured and before they are packaged, poses particular problems for the packaging of cigarettes. The cigarette-making machines manufacture cigarettes at a high output of, for example, sixteen thousand cigarettes per minute. The comparatively large number of cigarettes has to be fed to the packaging machine in an expedient manner. In this arrangement, manufacturing-related fluctuations in the output of the cigarette-making machine as well as those of the following packaging machine have to be taken into account. It is thus conventional for storage devices for cigarettes to be placed between said two units. Depending on the fluctuations in output, the cigarettes are conveyed into said store or discharged from the same.

So-called trays which can be filled from their upper side or their underside are known for storing and transporting cigarettes. In order to empty the trays, the upper side of the same is first of all closed by a slat, the trays are tilted through approximately 180° over an emptying station, and the trays are then entered into the emptying station. As a result of this complicated handling of the trays, the size of the storage device, into which several containers are assembled, is restricted.

SUMMARY OF THE INVENTION

The object of the invention is to propose a device for storing and handling cigarettes which, using containers for receiving a cigarette stock, exhibits a considerably larger storage capacity and permits facilitated handling during distribution of the stored cigarettes.

In order to achieve this object, the device according to the invention is characterized by the following features:

a) an interior for receiving the cigarettes of each container is bounded by a large-surface-area front wall, a large-surface-area rear wall, narrow side walls and a bottom wall, b) the cigarettes can be stored with their longitudinal axis transverse to the plane of the front wall, the width of the side wall and of the bottom wall corresponding approximately to the length of the cigarettes, c) the bottom wall exhibits an opening via which each container can be filled and emptied without any change in their relative position, d) the cross-section of the opening corresponds to the cross-section of the cigarette stream in the region of the cigarette conveyor.

According to the invention, the containers are filled through an opening arranged in the bottom wall and emptied again through the same opening. Tipping of the containers or emptying the same is not necessary. All that is needed is for the relevant container to be displaced into the filling station for filling or emptying. As a result, the handling of the containers is simplified considerably. Furthermore, this means that virtually any number of containers can be assembled into the storage unit.

Preferably, the bottom wall is mounted pivotably in the region of the filling opening and can be pivoted from an essentially horizontal normal position into a V-shaped position with at least one leg sloping down to the opening.

Upon filling a container which is empty or only slightly filled, the bottom wall is located first of all in a V-shaped position. If a certain degree of filling is reached, the bottom wall is pivoted from the V-shaped position into the normal position. In this position, a cuboidal container is obtained. Dead spaces which cannot be used for storing cigarettes are avoided.

Upon emptying such a container, first of all cigarettes are conveyed away with the bottom wall still located in the normal position. If the degree of filling falls below the predetermined degree of filling, the bottom wall is pivoted into the V-shaped position. In this manner, the container can be fully emptied.

The filling opening is preferably arranged in a central region of the bottom wall. In this case, the bottom wall is subdivided into two pivotable legs which extend on both sides of the filling opening. Consequently, even if the container is of a small height in comparison with its longitudinal extent, a sufficient angle of inclination of the bottom wall can be achieved in the V-shaped position. The two legs of the bottom wall can be pivoted in a particularly simple manner by in each case one actuating member, in particular a pressure-medium cylinder.

It is particularly favourable if the side walls are fitted pivotably on the bottom wall and can be pivoted into the V-shaped position together with said bottom wall. In this arrangement, the pivot movement of the bottom wall and of the side walls is controlled by sensors which detect the degree of filling of the container.

A further special feature of the invention relates to a cigarette conveyor for transporting the cigarettes from a cigarette-making machine to the filling station and from the filling station to a packaging machine. For this purpose, the invention makes use of two separate conveyor channels. One conveyor channel is used simply for feeding the cigarettes to the filling station, while a second conveyor channel serves simply for conveying the cigarettes away from the filling station. Consequently, better, disruption-free transportation of the cigarettes in the upward and downward direction is ensured without danger of the cigarettes being damaged.

Further features of the invention relate to the configuration of the containers and members in conjunction with the filling or emptying of the containers and to the configuration of the cigarette conveyor.

Exemplary embodiments of the invention are explained in more detail hereinbelow with reference to the drawings, in which:

DESCRIPTION OF PREFERRED EMBODIMENTS

Figure 1:
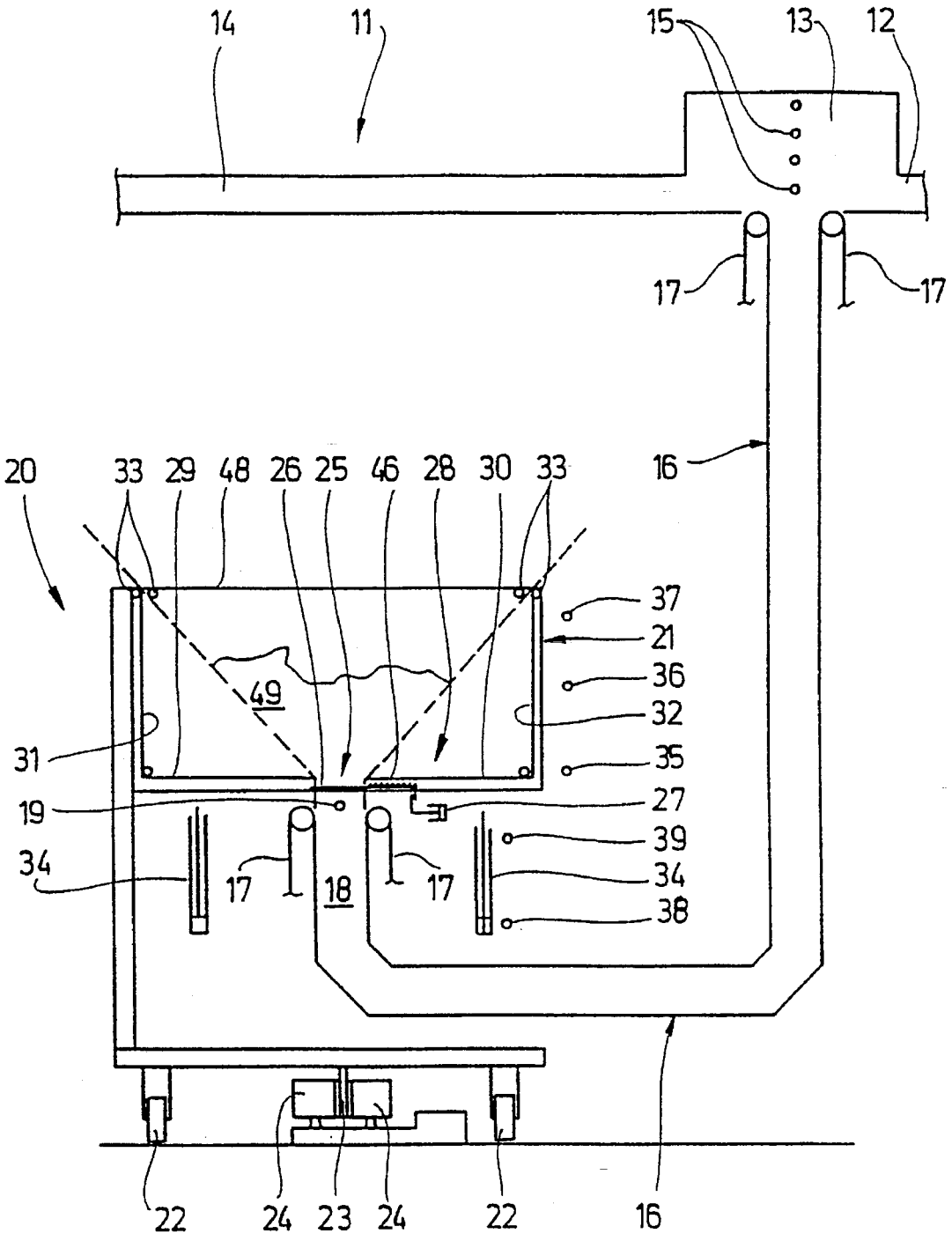
FIG. 1 shows a front view of the device in accordance with a first exemplary embodiment.

The exemplary embodiments represented in the drawings relate to the handling of cigarettes or other elongate, rod-like objects. The matter in question is the storage of a large number of cigarettes and the transportation thereof in the region between a cigarette-making machine and a packaging machine (neither of these are shown).

Figure 2:
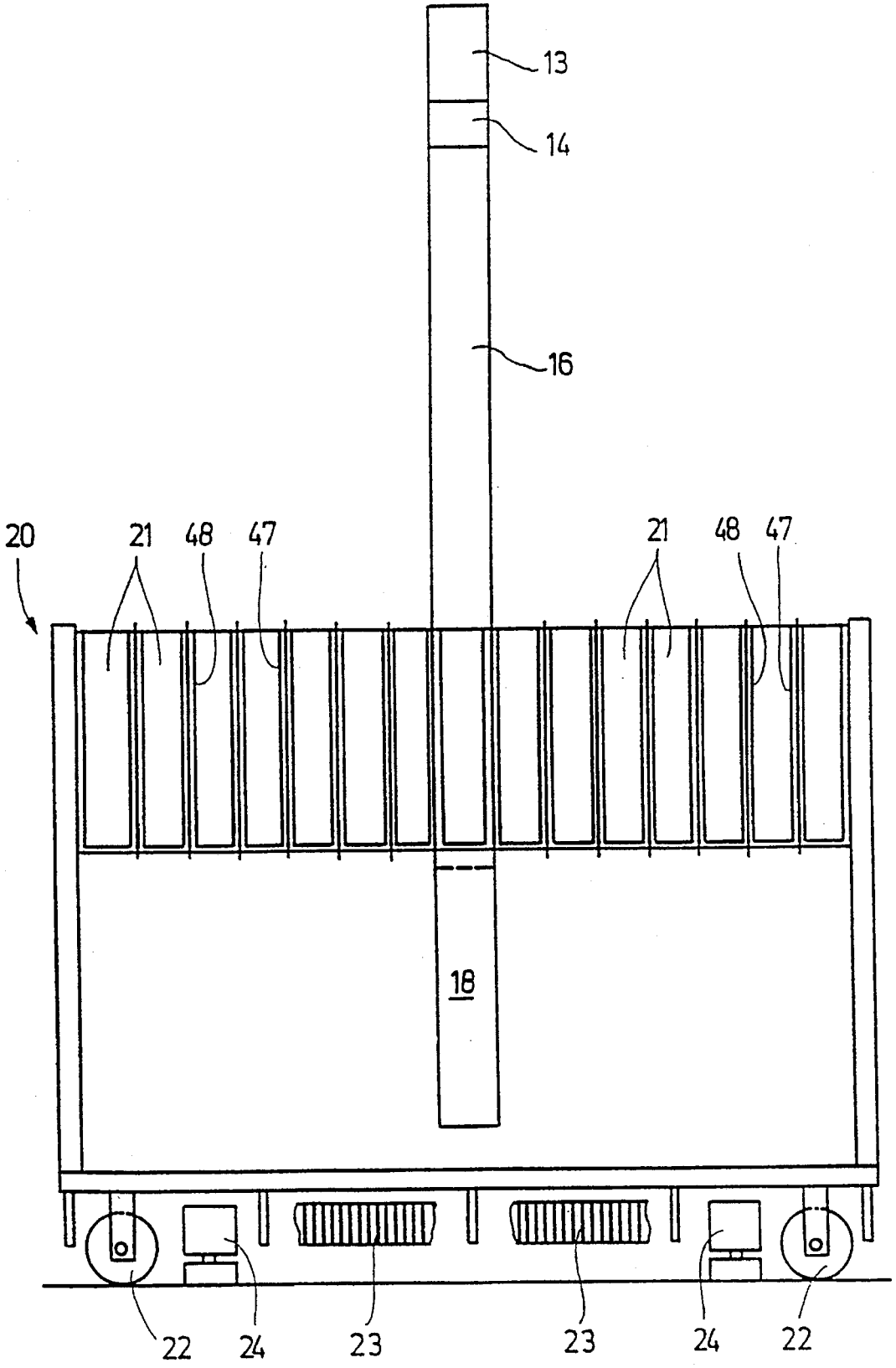
FIG. 2 shows a side view of the device according to FIG. 1.

A storage device 27 which adjoins the cigarette conveyor 11 is shown in FIGS. 1 and 2. The cigarette conveyor 11 exhibits a first section 12, which is connected to a cigarette-making machine. Furthermore, the cigarette conveyor exhibits a secondary store 13 and a second section 14, which is connected to a packaging machine. The secondary store 13 is assigned several sensors 15, which detect the degree of filling of the secondary store 13.

The storage unit 20 comprises a second cigarette conveyor 16, which communicates with the secondary store 13. The cigarette conveyor 16 exhibits endless belts 17, between which the cigarettes can be conveyed, forming a cigarette stream in doing so. At the end which is directed away from the secondary store 13, the cigarette conveyor 16 exhibits a filling station 18. The endless belts 17 are directed vertically in the region of said filling station 18. Furthermore, a sensor 19 is arranged in the region of the filling station 18. Said sensor 19 detects whether cigarettes are located in the region of the filling station 17.

The storage unit 20 interacts with the cigarette conveyor 16. Several chambers or containers 21 are fitted on the storage unit 20. The storage unit 20 can be displaced on wheels 22. Arranged in the region between the wheels 22 is a rack 23 which interacts with a drive system 24. The storage unit 20 can thus be moved such that each of the containers 21 can be moved into the filling station 18 of the cigarette conveyor 16.

Each container 21 is assigned an opening 25. Each opening 25 can be closed by a slide 26, which is retained in the closed position by a spring 46. An actuating member 27, e.g. a pressure-medium cylinder or an electromagnet, is arranged in the region of the filling station 18. The slide 26 of a container 21 which is located in the region of the filling station 18 is opened by an actuating member 27 in each case.

Each container 21 exhibits a large-surface-area front wall 47, a large-surface-area rear wall 48, a bottom wall 28 and two narrow side walls 31, 32. Said walls bound an interior 49 which is open at the top and is intended for receiving the cigarettes. In this arrangement, the width of the bottom wall 28 and of the side walls 31, 32 corresponds approximately to the length of the cigarettes. The latter are stored in the container 21 with their longitudinal axis transverse to the plane of the front wall 47. The opening for filling and emptying the containers 21 is located in the bottom wall 28.

The bottom wall of the container 21 can be pivoted. In the present case, the bottom wall 28 comprises two legs 29, 30 which are mounted pivotably in the region of the opening 25.

The side walls 31, 32 are fitted pivotably on the legs 29, 30 of the bottom wall 28. At their upper end, the side walls 31, 32 are each mounted displaceably and pivotably between two guide rails 33. The side walls 31, 32 are thus pivoted from the normal position into the V-shaped position together with the bottom wall 28. Actuating members for pivoting the bottom wall 28 and the side walls 31, 32 are arranged beneath the container 21. In the present case, pressure-medium cylinders 34 serve as actuating members. The bottom wall 28 and the side walls 31, 32 can thus be pivoted from the normal position (solid line) into a V-shaped position (represented by a broken line). The emptying of the containers 21 is thus facilitated.

A conventional sensor in the form of a lattice network (not shown) monitors whether individual cigarettes or a number of cigarettes are in a skewed position during filling or emptying.

Sensors 35, 36, 37 are arranged beside the container 21 in order to control the pivot movement of the bottom wall 28 and of the side walls 32, 33. The lowermost sensor 35 detects the normal position of the bottom wall 28 and of the side walls 31, 32. In this normal position, the bottom wall 28 is located in a horizontal position and the side walls 31, 32 located in a vertical position. The rest of the sensors 36, 37 serve to detect the degree of filling of the container 21. In this arrangement, the sensor 36 give a signal if the container is partially filled to a predetermined degree of filling, and the sensor 37 gives a signal when the container 21 is filled completely.

Further sensors 38, 39 are assigned to one of the pressure-medium cylinders 34. The lower sensor 38 is likewise triggered if the bottom wall 28 and the side walls 31, 32 are located in the normal position. The lower sensor 38 thus confirms the signal of the sensor 35. The upper sensor 39 is triggered if the bottom wall, together with the side walls 31, 32, is located in the V-shaped position.

The device thus described operates as follows: if the cigarette-making machine produces more cigarettes than can be removed by the packaging machine, some of the cigarettes are conveyed away from the cigarette conveyor 16 and fed to the filling station 18. A container 21 which is empty or not yet completely filled is moved into the filling station 18 and the slide 26 is opened. The position of the bottom wall 28 and of the side walls 31, 32 is controlled by the sensor 36. If a predetermined degree of filling of the container 21 has been reached, with the result that the sensor 36 is triggered, the pressure-medium cylinders 34 are retracted and the bottom wall 28 and the side walls 31, 32 are thus pivoted into the normal position. During this, cigarettes continue to be conveyed through the filling station 18 into the container 21, to be precise, until the sensor 37 is triggered.

If the predetermined degree of filling has not yet been reached, with the result that the sensor 36 is not triggered, the bottom wall 28 and the side walls 31, 32 remain in the V-shaped position, while cigarettes are conveyed into the container 21 until the sensor 36 is triggered.

Alternatively, the bottom wall 28 and the side walls 31, 32 may also be located in the normal position during the entire filling operation.

The container 21 is filled completely if both the sensor 37 and the sensor 38 are triggered. The conveying direction of the cigarette conveyor 16 is then reversed and the actuating member 27 is switched off, with the result that the slide 26 is displaced into the closed position by the spring force of the spring 46. Reversal of the conveying direction of the cigarette conveyor 16, causes the cigarettes to be conveyed into the secondary store 13 until the sensor 19 is released. Then, as necessary, a further container which is empty or not yet filled completely can be moved into the filling station 18.

If the cigarette-making machine is stopped or the output of the same is reduced, cigarettes can be removed from the containers 21 and fed to the packaging machine. For this purpose, a filled container 21 is moved into the region of the filling station 18 and the slide 26 is opened by the actuating member 27. Cigarettes then pass through the opening 25 into the filling station 18. By means of the cigarette conveyor 16, the cigarettes are fed into the secondary store 13 and from there to the packaging machine. In this case, the emptying of the containers 21 is controlled by the sensors 15 of the secondary store 13. To be precise, the conveyor 16 is stopped if the secondary store is filled completely.

If the degree of filling of the container 21 falls below the predetermined degree of filling thereof, which fact is detected by the sensor 36, the bottom wall 28 and the side walls 31, 32 are pivoted into the V-shaped position. The container 21 may then be emptied completely.

Complete emptying of the container 21 is, in this arrangement, detected by the sensor 19. The slide 24 is then moved into the closed position by the spring 46 and the bottom wall 28 and the side walls 31, 32 are pivoted into the normal position. This is detected by the sensors 35 and 38 and, if necessary, a further, filled container. 21 can be moved into the filling station 17.

Figure 3:
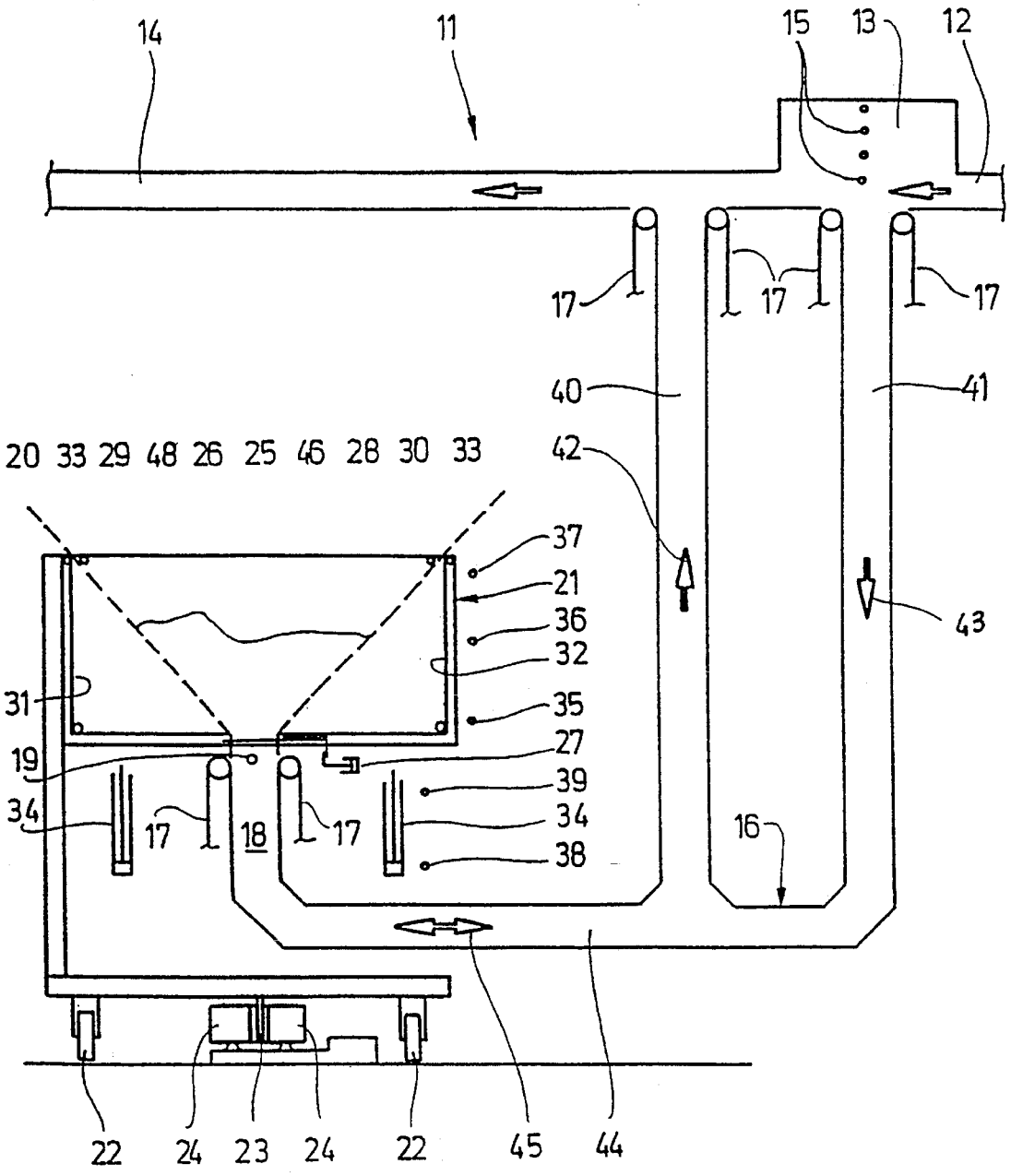
FIG. 3 shows a front view of the device according to a further exemplary embodiment.

A special configuration of the cigarette conveyor is shown in FIG. 3. The cigarette conveyor 16 here has two separate conveyor shafts 40 and 41. The conveyor shaft 40 serves for transporting the cigarettes in the upward direction, that is to say for emptying a container 21. The conveyor shaft 41 serves for transporting the cigarettes in the downward direction, that is to say for filling a container 21. The endless belts 17 in the region of the conveyor shafts 40, 41 can, accordingly, be driven in only one direction, as is indicated by the arrows 42, 43. While cigarettes are fed to the filling station 18 by way of the conveyor shaft 41, the endless belts 17 of the conveyor shaft 40 are at a standstill. On the other hand, the endless belts 17 of the conveyor shaft 41 are at a standstill if cigarettes are conveyed away from the filling station 18 by way of the conveyor shaft 40. In the region of a horizontal conveyor shaft 44 of the cigarette conveyor 16, the conveyor belts 17 can be driven in both directions corresponding to the double arrow 45. Consequently, better, disruption-free transportation of the cigarettes in the upward and downward directions is ensured without danger of the cigarettes being damaged.

As sensors, use can be made of all suitable types, e.g. light barriers. The expansion angle of the bottom wall 28 and of the side walls 31, 32 in the V-shaped position should be 90°, that is to say 45° with respect to the horizontal plane.

According to an exemplary embodiment which is not represented, the filling opening 25 is arranged in a border region of the bottom wall 28. In this case, the bottom wall 28 has only one pivotable leg.

We claim:

1. Device for transporting and storing cigarettes, having a storage unit (20) comprising a plurality of containers (21) which are arranged one beside the other and are connected fixedly to one another, having an interior (49) for receiving the cigarettes, which interior is bounded by a large-surface-area front wall (47), a large-surface-area rear wall (48), narrow side walls (31, 32) and a bottom wall (28), and in which the cigarettes can be stored with their longitudinal axes transverse to the plane of the front wall (47), and having a conveyor (16) for feeding the cigarettes, in particular, from a cigarette-making machine and conveying away the cigarettes, in particular, to a packaging machine, it being possible for the individual containers (21) to be filled or emptied one after the other in a filling station (18) by the conveyor (16), characterized in that the bottom wall (28) is mounted pivotably in the region of the filling opening (25) and can be pivoted from an essentially horizontal normal position into an oblique position, sloping down to the filling opening (25), by means of at least one leg (29, 30) which slopes down to the filling opening (25).

2. Device according to claim 1, characterized in that the filling opening (25) is arranged in a central region of the bottom wall (28), with the result that the bottom wall (28) is subdivided into two pivotable legs (29, 30) which extend on both sides of the filling opening (25).

3. Device according to claim 2, characterized in that each leg (29, 30) of the bottom wall (28) is assigned an actuating member, in particular a pressure-medium cylinder (34), for pivoting said bottom wall into the V-shaped position.

4. Device according to claim 2, characterized in that the side walls (31, 32) are fitted pivotably on the bottom wall (28) and can be pivoted into the V-shaped position together with said bottom wall.

5. Device according to claim 1, characterized by a sensor (36) for detecting a predetermined degree of filling of the container (21), the bottom wall (28), upon reaching the predetermined degree of filling during the filling process, being pivoted from the horizontal position into the V-shaped position and, upon emptying, being pivoted from the V-shaped position into the horizontal position.

6. Device according to claim 1, characterized in that several containers (21) are assembled into a displaceable container magazine (20), in particular for transporting the containers (21) in the region of a filling station (18) for filling and emptying the containers (21) one after the other.

7. Device according to claim 1, characterized in that the filling opening (25) is assigned a slide (26) so that it can be closed.

8. Device according to claim 7, characterized in that an actuating member (27), in particular a pressure-medium cylinder (34), an electromagnet or the like, for actuating the slide (26) is arranged in the region of the filling station (18).

9. Device according to claim 8, characterized in that the slide (26) is retained in a closed position by a spring (46) and can be displaced counter to the spring force by an actuating member (27) into an opening position.

10. Device according to claim 1, characterized by a sensor for detecting skewed positions of individual cigarettes or a number of cigarettes.

11. Device, in particular, according to claim 1, characterized in that a cigarette conveyor (16) for transporting the cigarettes from a cigarette-making machine to the filling station (18) and from the filling station (18) to a packaging machine exhibits two separate conveyor channels (40, 41) for feeding the cigarettes to the filling station (18) and for conveying the cigarettes away from the filling station (18).

12. Device according to claim 11, characterized in that an intermediate store (13) is arranged above at least one conveyor channel (41).

13. Device according to claim 12, characterized in that the intermediate store (13) is assigned sensors (15) for detecting the degree of filling.

* * * * *